US010765283B2

(12) United States Patent
Li

(10) Patent No.: US 10,765,283 B2
(45) Date of Patent: Sep. 8, 2020

(54) BIDIRECTIONAL MOBILE CLEANING DEVICE

(71) Applicant: HiZero Technologies Co., Ltd., Shenzhen (CN)

(72) Inventor: Yang Li, Guangdong (CN)

(73) Assignee: HiZero Technologies Co., Ltd., Shenzhen (CN)

( * ) Notice: Subject to any disclaimer, the term of this patent is extended or adjusted under 35 U.S.C. 154(b) by 111 days.

(21) Appl. No.: 16/100,546

(22) Filed: Aug. 10, 2018

(65) Prior Publication Data

US 2019/0246856 A1 Aug. 15, 2019

Related U.S. Application Data

(63) Continuation-in-part of application No. PCT/CN2018/076704, filed on Feb. 13, 2018.

(51) Int. Cl.
*A47L 9/28* (2006.01)
*A47L 9/00* (2006.01)

(52) U.S. Cl.
CPC ..... *A47L 9/2847* (2013.01); *A47L 9/009* (2013.01); *A47L 9/0072* (2013.01); *A47L 9/2842* (2013.01); *A47L 2201/04* (2013.01); *A47L 2201/06* (2013.01)

(58) Field of Classification Search
CPC .. A47L 11/18; A47L 11/4041; A47L 11/4013; A47L 11/4044; A47L 11/4016; A47L 11/282; A47L 9/0477
See application file for complete search history.

(56) References Cited

U.S. PATENT DOCUMENTS 1,849,218 A 3/1932 Beach
10,136,781 B2 * 11/2018 Li ..... A47L 11/282
2003/0196294 A1 * 10/2003 Conrad ..... A01B 33/082 15/331

(Continued)

FOREIGN PATENT DOCUMENTS

CN 201064424 Y 5/2008
CN 201524035 U * 7/2010

(Continued)

OTHER PUBLICATIONS

Corresponding European Patent Application No. 18250026.4, Extended European Search Report dated Aug. 8, 2019.

(Continued)

*Primary Examiner* — Shay Karls
(74) *Attorney, Agent, or Firm* — Cooper Legal Group, LLC

(57) ABSTRACT

The disclosure relates to a bidirectional mobile cleaning device comprising a garbage collection box, a first rolling member disposed at one end of the garbage collection box, and a second rolling member disposed at the other end of the garbage collection box. The first rolling member rotates to collect and adsorb garbage and sewage on the ground and feed it into the garbage collection box. The second rolling member rotates in a direction opposite to the direction with which the first rolling member rotates to collect and absorb garbage and sewage on the ground and feed it into the garbage collection box. The bidirectional mobile cleaning device is driven to move based on a speed difference between the first and second rolling members.

20 Claims, 2 Drawing Sheets

(56) References Cited

U.S. PATENT DOCUMENTS

| | | | | |
|---|---|---|---|---|
| 2013/0333129 | A1* | 12/2013 | Bradbury | A47L 13/20 15/105 |
| 2014/0209122 | A1* | 7/2014 | Jung | A47L 11/4011 134/18 |
| 2018/0206685 | A1 | 7/2018 | Li et al. | |
| 2019/0104900 | A1 | 4/2019 | Li et al. | |

FOREIGN PATENT DOCUMENTS

| | | | |
|---|---|---|---|
| CN | 201524035 | U | 7/2010 |
| CN | 201578183 | U | 9/2010 |
| CN | 201929884 | U | 8/2011 |
| CN | 201981498 | U | 9/2011 |
| CN | 203213052 | U | 9/2013 |
| CN | 104984939 | A | 10/2015 |
| DE | 102015117922 | A1 | 4/2017 |
| EP | 2443978 | B1 | 1/2017 |
| EP | 3238597 | A1 | 11/2017 |
| JP | 48054463 | | 7/1973 |
| JP | H0240086 | Y2 | 10/1990 |
| KR | 101202801 | B1 | 11/2012 |
| KR | 101552121 | B1 | 9/2015 |
| WO | 2017200233 | A1 | 11/2017 |

OTHER PUBLICATIONS

Corresponding Great Britain Patent Application No. GB1815898.0, Combined Search Report dated Feb. 25, 2019.
Corresponding European Patent Application No. 18250026.4, Search Report dated May 6, 2019.
Corresponding Japanese Patent Application No. 2018-219920, Office Action dated Dec. 23, 2019. English Translation.

* cited by examiner

BIDIRECTIONAL MOBILE CLEANING DEVICE

RELATED APPLICATIONS

This application is a continuation-in-part of and claims priority to PCT/CN2018/076704, filed on Feb. 13, 2018, which is incorporated herein by reference.

FIELD OF THE DISCLOSURE

The present disclosure relates to the technical field of bionic cleaning robots, in particular to a bidirectional mobile cleaning device.

BACKGROUND OF THE DISCLOSURE

A bionic cleaning robot is an intelligent cleaning device that can automatically clean the ground. Traditional bionic cleaning robots generally use a clean, flexible roller to perform cleaning operations on the ground and have only one, forward cleaning direction. The problem with this conventional design is that die garbage behind the flexible roller cannot be effectively cleaned up. When the bionic cleaning robot reverses direction, the back surface of a garbage scraper lip for scooping the garbage off the ground will scoot the garbage, inhibiting the garbage from being collected and stored in the bionic cleaning robot. Thus, the conventional bionic cleaning robot has the drawback of being unable to clean thoroughly when moving in reverse, resulting in a decrease in cleaning efficiency.

SUMMARY OF THE DISCLOSURE

Based on this, the present disclosure provides a bidirectional mobile cleaning device, which is provided with oppositely-rotating rolling members at ends of a garbage collection box. A speed difference between the rolling members is used to drive the device to move while cleaning, so that the ground can be thoroughly cleaned during both forward and backward motion. Thus, cleaning efficiency is improved.

A bidirectional mobile cleaning device comprises: a garbage collection box, and a first rolling member installed at one end of the garbage collection box, wherein the first rolling member rotates to collect the garbage and sewage on the ground and feed the garbage and sewage into the garbage collection box. The bidirectional mobile cleaning device also comprises a second rolling member installed at the other end of the garbage collection box, wherein the second rolling member rotates to collect the garbage and sewage on the ground and feed the garbage and sewage into the garbage collection box and the direction of rotation of the second rolling member is opposite to the direction of rotation of the first rolling member.

In the above-described bidirectional mobile cleaning device, the first rolling member and the second rolling member serve as a cleaning member, and garbage and sewage are fed into the garbage collection box while moving. The first rolling member and the second rolling member nib against the ground. The rotation direction of the first rotting member and the second rolling member are opposite each other. By controlling the difference in rotation speed between the two rolling members, the device can be controlled to move forward or backward. Moreover, since the first rolling member and the second rolling member are respectively disposed at opposite ends of the garbage collection box, whether the device is moving forward or backward, garbage and sewage on the ground can be collected, thereby improving the cleaning efficiency. Through the above design, the oppositely-rotating rolling members are disposed on opposite ends of the garbage collection box, and the device is driven to move based upon the speed difference between the rolling members while cleaning, thereby thoroughly cleaning the ground during forward and backward movement and improving cleaning efficiency.

In one embodiment, one end of the garbage collection box is provided with a first garbage scraper lip. The first garbage scraper lip, in cooperation with the first rolling member, is used to feed garbage and sewage on the ground into the garbage collection box. The other end of the garbage collection box is provided with a second garbage scraper lip. The second garbage scraper lip, in cooperation with the second rolling member, is used to feed garbage and sewage on the ground into the garbage collection box. The first garbage scraper lip scoops garbage and sewage from the ground toward an edge of the first rolling member, so that the garbage and sewage are caught between the first rolling member and the first garbage scraper lip and fed by the first rolling member into the garbage collection box. The second garbage scraper lip scoops garbage and sewage from the ground toward an edge of the second rolling member, so that the garbage and sewage are caught between the second rolling member and the second garbage scraper lip and fed by the second rolling member into the garbage collection box.

In one embodiment, the bidirectional mobile cleaning device further comprises a first brush member and a second brush member located over or in the garbage collection box. The first brush member is configured to remove garbage that adheres to the first rolling member from the first rolling member, and the second brush member is configured to remove garbage that adheres to the second rolling member from the second rolling member. The first brush member rubs against the first rolling member so that the garbage adhering to the first rolling member falls into the garbage collection box, preventing the garbage from being brought back out of the garbage collection box by the first rolling member. The second brush member rubs against the second rolling member so that the garbage adhering to the second rolling member falls into the garbage collection box, preventing the garbage from being brought back out of the garbage collection box by the second rolling member.

In one embodiment, both the first brush member and the second brush member are rotating brushes. The use of rotating brushes helps to increase the efficiency of the brush members.

In one embodiment, the bidirectional mobile cleaning device further comprises a first sewage recovery member adjacent to the first rolling member and a second sewage recovery member adjacent to the second rolling member. The first sewage recovery member is used to recover sewage that is absorbed on the first rolling member. The second sewage recovery member is used to recover sewage that is adsorbed on the second rolling member. Sewage that is adsorbed on the first rolling member is recovered through the first sewage recovery member to avoid secondary pollution. Sewage that is adsorbed on the second rolling member is recovered through the second sewage recovery member to avoid secondary pollution.

In one embodiment, the first sewage recovery member defines a sink structure. A bottom portion of the first sewage recovery member is provided with a first pressing portion having a convex portion that presses the first rolling member. The bottom of the first sewage recovery member is provided with a first through hole that communicates with a surface of the first rolling member. The first through hole is located on one side of the first pressing portion. The second sewage recovery member defines a sink structure. A bottom portion of the second sewage recovery member is provided with a second pressing portion having a convex portion that presses the second rolling member. The bottom of the second sewage recovery member is provided with a second through hole that communicates with a surface of the second rolling member. The second through hole is located on one side of the second pressing portion. The sewage in the first rolling member is extruded by the first pressing portion and is discharged into the first sewage recovery member through the first through hole. The sewage in the second rolling member is extruded by the second pressing portion, and is discharged into the second sewage recovery member through the second through hole.

In one embodiment, there is a plurality of first through holes distributed in an array at the bottom of the first sewage recovery member, and there is a plurality of second through holes distributed in an array at the bottom of the second sewage recovery member.

In one embodiment, a first water supply port is provided at one end of the first sewage recovery member, a first sewage collection port is provided at the other end of the first sewage recovery member, a second water supply port is provided at one end of the second sewage recovery member, and a second sewage collection port is provided at the other end of the second sewage recovery member. Sewage that has accumulated in the first sewage recovery member is taken away through the first sewage collection port, and the first rolling member is supplemented with clean water or a cleaning liquid using the first water supply port. Sewage that has accumulated in the second sewage recovery member is taken away through the second sewage collection port, and the second rolling member is supplemented with clean water or a cleaning liquid using the second water supply port.

In one embodiment, a bottom of the garbage collection box is provided with a load-bearing wheel. The load-bearing wheel serves to relieve the load of the first rolling member and the second rolling member.

In one embodiment, the first rolling member is a flexible roller or a flexible belt or roller brush.

In one embodiment, the first rolling member comprises a plurality of rolling members arranged side-by-side.

In one embodiment, the first rolling member comprises a plurality of first rollers arranged in series.

In one embodiment, the second rolling member is a flexible roller or a flexible belt or roller brush.

In one embodiment, the second rolling member comprises a plurality of rolling members arranged side-by-side.

In one embodiment, the second rolling member comprises a plurality of rolling members arranged in series.

In one embodiment, the bidirectional mobile cleaning device further comprises a first driver connected to the first rolling member and a second driver connected to the second rolling member. The first driver is used to drive the first rolling member to rotate, and the second driver is used to drive the second rotting member to rotate.

In one embodiment, the first driver is an electric motor or a hydraulic drive or a pneumatic motor.

In one embodiment, the second driver is an electric motor or a hydraulic drive or a pneumatic motor.

In one embodiment, a first transmission member is disposed between the first driver and the first rolling member. The first transmission member is a helical tooth or a cone tooth or a face tooth or a worm gear.

In one embodiment, a second transmission member is disposed between the second driver and the second rolling member. The second transmission member is a helical tooth or a cone tooth or a face tooth or a worm gear.

BRIEF DESCRIPTION OF THE DRAWINGS

In order to more clearly explain the embodiments of the present disclosure or the technical solutions relative to the prior art, the drawings to be used in the description of the embodiments or the prior art will be briefly described below. Obviously, the drawings in the following description are only some embodiments of the present disclosure. For those skilled in the art, drawings of other embodiments can also be obtained based on these drawings without any creative work.

Figure 1:
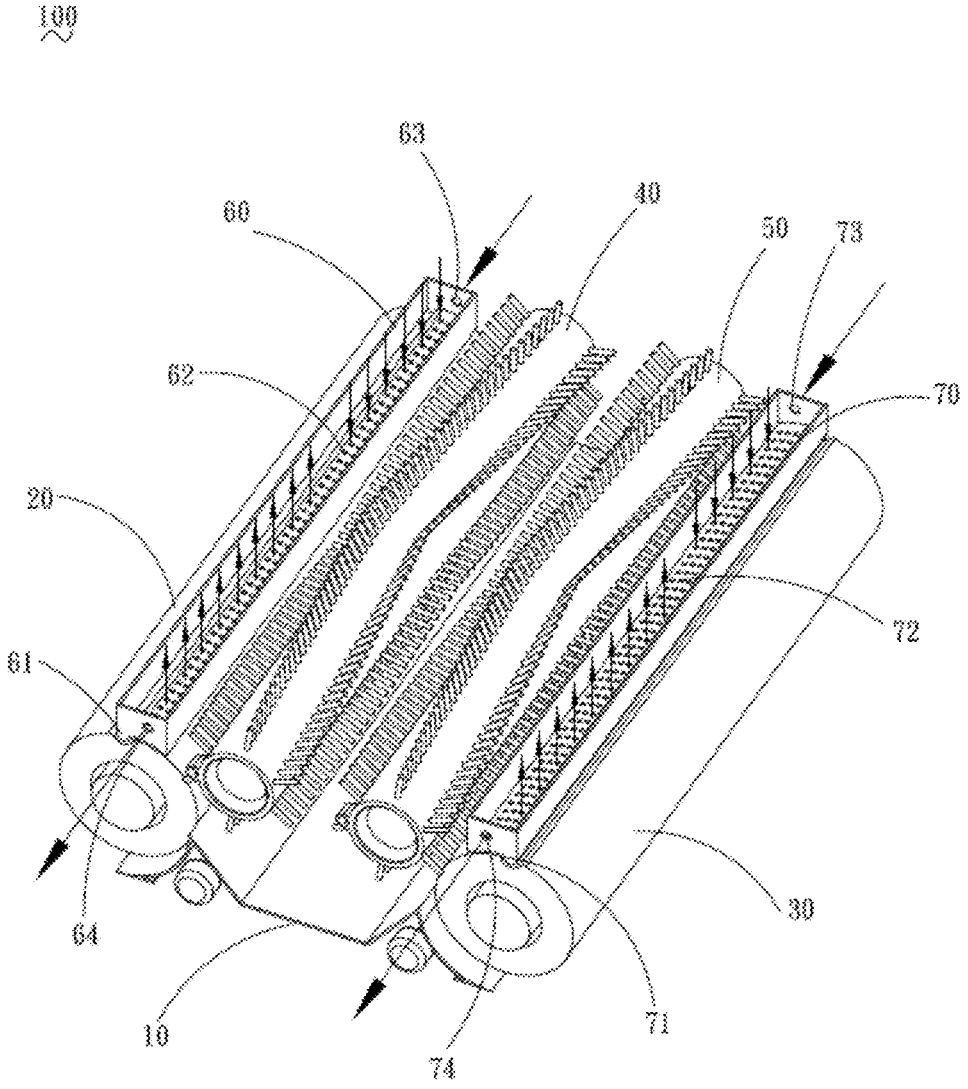
FIG. 1 is a schematic perspective view of a bidirectional mobile cleaning device according to a first embodiment of the present disclosure.

The meaning of each label in the drawings is: 100—bidirectional mobile cleaning device; 10—garbage collection box; 11—box body; 12—first guide plate; 13—second guide plate; 14—first garbage scraper lip; 15—second garbage scraper lip; 16—load-bearing wheel; 20—first rolling member; 21—first driver; 30—second rolling member; 31—second driver; 40—first brush member; 41—first roller brush motor; 50—second brush member; 51—second roller brush motor; 60—first sewage recovery member; 61—first pressing portion; 62—first through hole; 63—first water supply port; 64—first sewage collection port; 70—second sewage recovery member; 71—second pressing portion; 72—second through hole; 73—second water supply port; 74—second sewage collection port.

DETAILED DESCRIPTION OF THE EMBODIMENTS

To facilitate the understanding of the present disclosure, the present disclosure will be described more fully hereinafter with reference to the accompanying drawings. The preferred embodiments of the disclosure are given in the accompanying drawings. However, the present disclosure may be embodied in many different forms and is not limited to the embodiments described herein. Rather, these embodiments are provided so that this disclosure will be thorough and complete. It should be noted that when an element is referred to as being "fixed" to another element, it may be directly on the other element or there may also be an intervening element. When an element is considered to "connect" another element, it can be directly connected to another element or there may be an intervening element. Unless otherwise defined, all technical and scientific terms used herein have the same meaning as commonly understood by one of ordinary skill in the art to which this disclosure belongs. The terminology used in the description of the present disclosure is for the purpose of describing particular embodiments only and is not intended to limit the present disclosure. Moreover, the term "and/or" as used herein includes any and all combinations of one or more of the associated listed items.

Figure 2:
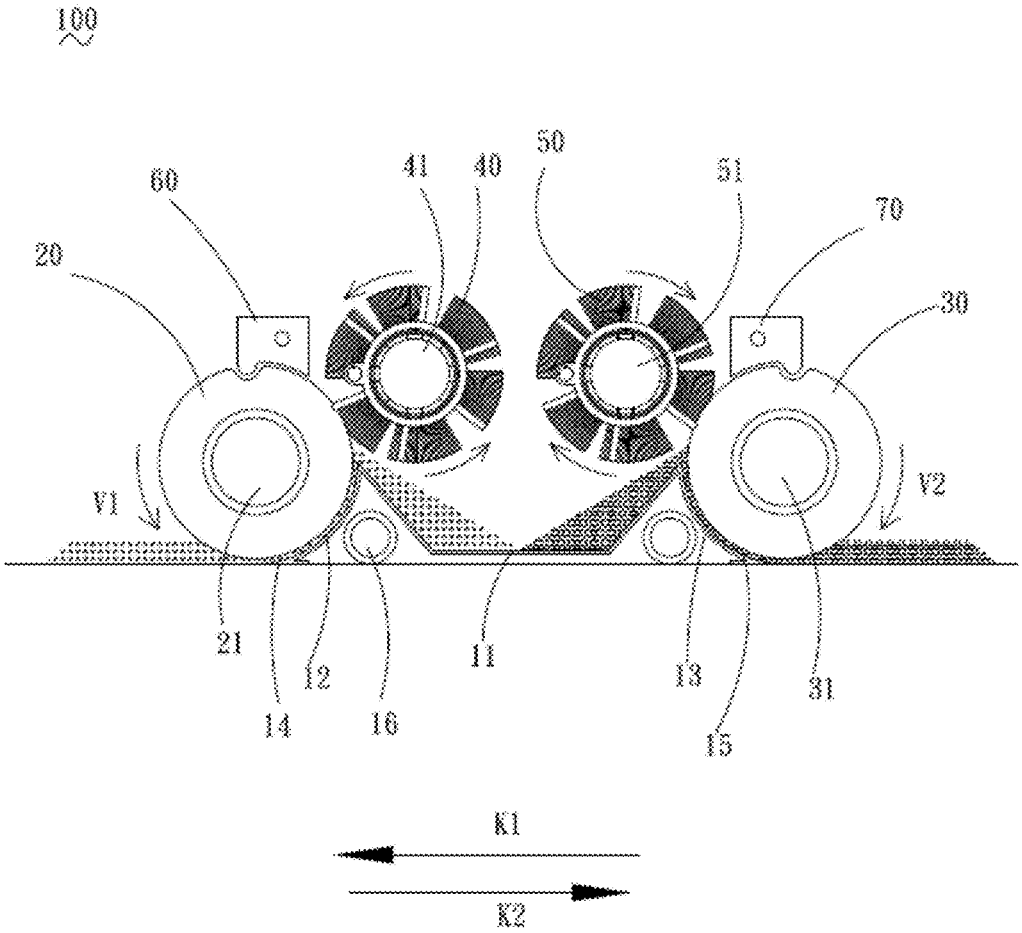
FIG. 2 is a side view of the bidirectional mobile cleaning device shown in FIG. 1.

Referring to FIGS. 1 and 2, a schematic diagram of a bidirectional mobile cleaning device 100 according to a first embodiment of the present disclosure is illustrated. As shown in FIG. 1, the bidirectional mobile cleaning device 100 comprises a garbage collection box 10, a first rolling member 20 disposed at one end of the garbage collection box 10, and a second rolling member 30 disposed at the other end of the garbage collection box 10.

The direction of rotation of the second rolling member 30 is opposite to the direction of rotation of the first rolling member 20 (as shown in FIG. 2). The rotation speed and direction of the first rolling member 20 is marked as V1, and the rotation speed and direction of the second rolling member 30 is marked as V2. V1 is counterclockwise, and V2 is clockwise. When the absolute value of V1 is greater than the absolute value of V2, the bidirectional mobile cleaning device 100 moves in the direction of arrow K1. When the absolute value of V1 is less than the absolute value of V2, the bidirectional mobile cleaning device 100 moves in the direction of arrow K2. The garbage collection box 10 is used to collect garbage and sewage. The first rolling member 20 rotates to collect garbage and sewage on the ground and feed the garbage and sewage into the garbage collection box 10, and the second rolling member 30 rotates to collect garbage and sewage on the ground and feed the garbage and sewage into the garbage collection box 10.

In this embodiment, the garbage collection box 10 comprises a box body 11, a first guide plate 12 connected to one end of the box body 11, and a second guide plate 13 connected to the other end of the box body 11. The first guide plate 12 is disposed adjacent an inner side of the first rolling member 20, and serves to guide garbage and sewage into the box body 11 during the rotation of the first rolling member 20. The second guide plate 13 is disposed adjacent an inner side of the second rolling member 30 and serves to guide garbage and sewage into the box body 11 during the rotation of the second rolling member 30. Further, improvements can also be made to the garbage collection box 10.

For example, in the present embodiment, one end of the garbage collection box 10 is provided with a first garbage scraper lip 14 located at the outer end of the first guide plate 12. The first garbage scraper lip 14 feeds garbage and sewage on the ground into the garbage collection box 10 in cooperation with the first rolling member 20. The other end of the garbage collection box 10 is provided with a second garbage scraper lip 15 located at the outer end of the second guide plate 13. The second garbage scraper lip 15 feeds garbage and sewage on the ground into the garbage collection box 10 in cooperation with the second rolling member 30. The first garbage scraper lip 14 scoops garbage and sewage from the ground toward the edge of the first rolling member 20, so that the garbage and sewage are caught between the first rolling member 20 and the first garbage scraper lip 14 and fed by the first rolling member 20 into the garbage collection box 10. The second garbage scraper lip 15 scoops garbage and sewage from the ground near the edge of the second rolling member 30, so that the garbage and sewage are caught between the second rolling member 30 and the second garbage scraper lip 15 and fed by the second rolling member 30 into the garbage collection box 10.

In addition, in the present embodiment, the bottom of the garbage collection box 10 is further provided with a load-bearing wheel 16. The load-bearing wheel 16 serves to relieve the load of the first rolling member 20 and the second rolling member 30.

Considering that garbage adheres to the first rolling member 20 and/or the second rolling member 30 and may not easily fall into the garbage collection box 10, additional improvement can be made to ensure that garbage adhering to the first rolling member and/or the second rolling member 30 is collected in the garbage collection box 10. For example, in this embodiment, the bidirectional mobile cleaning device 100 further comprises a first brush member 40 and a second brush member 50 located over or in the garbage collection box 10. The first brush member 40 is configured to remove garbage that adheres to the first rolling member 20 from the first rolling member 20. The second brush member 50 is configured to remove garbage that adheres to the second rolling member 30 from second rolling member 30. The first brush member 40 rubs against the first rolling member 20 so that garbage adhering to the first rolling member 20 falls into the garbage collection box 10, preventing the garbage from being brought back out of the garbage collection box 10 by the first rolling member 20. The second brush member 50 rubs against the second rolling member 30 so that the garbage adhering to the second rolling member 30 falls into the garbage collection box 10, preventing the garbage from being brought back out of the garbage collection box 10 by the second rolling member 30.

Further, both the first brush member 40 and the second brush member 50 are rotating brush members. The use of rotating brush members helps to increase the efficiency of the bidirectional mobile cleaning device 100, wherein the rotating direction of the first brush member 40 is the same as that of the first rolling member 20, but the direction of the linear velocity at a contact point of the first brush member 40 and the first rolling member 20 is opposite. The rotating direction of the second brush member 50 is the same as that of the second rolling member 30, but the linear velocity direction at a contact point of the second brush member 50 and the second rolling member 30 is opposite. It can be understood that there is a linear velocity difference at the contact point between the first brush member 40 and the first rolling member 20, thereby improving the brushing efficiency. Further, in the present embodiment, the first brush member 40 is provided with a separate driver, that is, a first roller brush motor 41. Similarly, the second brush member 50 is also provided with a separate driver, that is, a second roller brush motor 51.

Considering that there may remain sewage on the first rolling member 20 and the second rolling member 30, additional improvements can be made to remove the sewage on the first rolling member 20 and the second rolling member 30. For example, in the present embodiment, the bidirectional mobile cleaning device 100 further comprises a first sewage recovery member 60 adjacent to the first rolling member 20 and a second sewage recovery member 70 adjacent to the second rolling member 30. The first sewage recovery member 60 is used to recover sewage that is adsorbed on the first rolling member 20. The second sewage recovery member 70 is used to recover sewage that is adsorbed on the second rolling member 30. Sewage that is adsorbed on the first rolling member 20 is recovered through the first sewage recovery member 60 to avoid secondary pollution. Sewage that is absorbed on the second rolling member 30 is recovered through the second sewage recovery member 70 to avoid secondary pollution.

Further, in the present embodiment, the first sewage recovery member 60 defines a sink structure. A bottom portion of the first sewage recovery member 60 is provided with a first pressing portion 61 having a convex portion that presses the first rolling member 20. The bottom of the first sewage recovery member 60 is provided with a first through hole 62 that communicates with a surface of the first rolling member 20. The first through hole 62 is located on one side of the first pressing portion 61. The second sewage recovery member 70 defines a sink structure. A second portion of the second sewage recovery member 70 is provided with a second pressing portion 71 having a convex portion that presses the second rolling member 30. The bottom of the second sewage recovery member 70 is provided with a second through hole 72 that communicates with a surface of the second rolling member 30. The second through hole 72 is located on one side of the second pressing portion 71. The sewage in the first rolling member 20 is extruded by the first pressing portion 61, and is discharged into the first sewage recovery member 60 through the first through hole 62. The sewage in the second rolling member 30 is extruded by the second pressing portion 71 and is discharged into the second sewage recovery member 70 through the second through hole 72.

In one embodiment, there is a plurality of first through holes 62 distributed in an array at the bottom of the first sewage recovery member 60 and there is a plurality of second through holes 72 distributed in an array at the bottom of the second sewage recovery member 70.

Considering that the sewage may accumulate in the first sewage recovery member 60 and the second sewage recovery member 70, additional improvements can be made to remove the sewage from the first sewage recovery member 60 and the second sewage recovery member 70. For example, in the present embodiment, a first water supply port 63 is provided at one end of the first sewage recovery member 60, and a first sewage collection port 64 is provided at the other end of the first sewage recovery member 60. A second water supply port 73 is provided at one end of the second sewage recovery member 70, and a second sewage collection port 74 is provided at the other end of the second sewage recovery member 70. Sewage that has accumulated in the first sewage recovery member 60 is taken away through the first sewage collection port 64, and the first rolling member 20 is supplemented with clean water or a cleaning liquid using the first water supply port 63. Sewage that has accumulated in the second sewage recovery member 70 is taken away through the second sewage collection port 74, and the second rolling member 30 is supplemented with clean water or a cleaning liquid using the second water supply port 73.

The first rolling member 20 and the second rolling member 30 may be implemented using a plurality of different structural arrangements.

For example, the first rolling member 20 may be a flexible roller or a flexible belt or roller brush.

For example, the first rolling member 20 may comprise a plurality of first rollers arranged side-by-side.

For example, the first rolling member 20 may comprise a plurality of first rollers arranged in series.

For example, the second rolling member 30 may be a flexible roller or a flexible belt or roller brush.

For example, the second rolling member 30 may comprise a plurality of arranged side-by-side.

For example, the second rolling member 30 may comprise a plurality of second rollers arranged in series.

In one embodiment, both the first rolling member 20 and the second rolling member 30 adopt a flexible roller design. In other embodiments, the first rolling member 20 and the second rolling member 30 may each be a single flexible belt or a side-by-side double flexible belt, which is similar in structure to a track. Moreover, the first rolling member 20 and the second rolling member 30 may be a roller brush, which can be made of a flexible material and can not only remove the garbage but also absorb the sewage. Further, whether the first rolling member 20 and the second rolling member 30 are a flexible roller or a flexible belt or a roller brush, multiple arrangements or structures can be used in combination using a side-by-side arrangement or a tandem arrangement.

For the power source, the first rolling member 20 and the second rolling member 30 may be driven by a single driver in conjunction with a transmission member, or separate drivers may be provided.

For example, in the present embodiment, the bidirectional mobile cleaning device 100 further includes a first driver 21 connected to the first rolling member 20 and a second driver 31 connected to the second rolling member 30. The first driver 21 is used to drive the first rolling member 20 to rotate. The second driver 31 is used to drive the second rolling member 30 to rotate.

The first driver 21 can be an electric motor or a hydraulic drive machine or a pneumatic machine. Similarly, the second driver 31 can be an electric motor or a hydraulic drive or a pneumatic machine. The first driver 21 and the second driver 31 may directly connect to the first rolling member 20 and the second rolling member 30, respectively, or may be indirectly driven by a transmission member.

For example, a first transmission member may be disposed between the first driver 21 and the first rolling member 20. The first transmission member may be a helical or tapered tooth or a face tooth or a worm gear.

For example, a second transmission member may be disposed between the second driver 31 and the second rolling member 30. The second transmission member may be a helical or tapered tooth or a face tooth or a worm gear.

The above-described bidirectional mobile cleaning device 100, the first rolling member 20, and the second rolling member 30 serve as a cleaning member, and the garbage and sewage are fed into the garbage collection box 10 while moving. The first rolling member 20 and the second rolling member 30 move the bidirectional mobile cleaning device 100 while rubbing against the ground, wherein the rotation direction of the first rolling member 20 is opposite the rotation direction of the second rolling member 30. By controlling the difference in the rotation speed between the first rolling member 20 and the second rolling member 30, the bidirectional mobile cleaning device 100 can be controlled to move forward or backward. In addition, since the first rolling member 20 and the second rolling member 30 are respectively disposed at opposite ends of the garbage collection box 10, whether the bidirectional mobile cleaning device 100 is moving forward or backward, garbage and sewage on the ground can be collected, thereby improving cleaning efficiency of the bidirectional mobile cleaning device 100. Through the above design, oppositely-rotating rolling members are provided at both ends of the garbage collection box 10, and the bidirectional mobile cleaning device 100 is driven to move based on the speed difference between the rolling members.

The technical features of the above-described embodiments may be combined arbitrarily. To make the description succinct, all the possible combinations of the technical features in the above embodiments are not described. However, as long as there is no contradiction in the combination of these technical features, all should be considered as described in this specification. The above-mentioned embodiments merely represent several embodiments of the present invention, and the description thereof is more specific and detailed, but it should not be understood as a limitation of the scope of the present invention. It should be noted that, for those skilled in the art, several variations and improvements may be made without departing from the concept of the present invention, and these are all within the protection scope of the present invention. Therefore, the scope of protection of the present invention shall be subject to the appended claims.

The invention claimed is:

1. A bidirectional mobile cleaning device, comprising:

a garbage collection box;

a first rolling member disposed at a first end of the garbage collection box, wherein the first rolling member rotates to collect garbage and sewage on the ground and feed the garbage into the garbage collection box; and a second rolling member disposed at a second end of the garbage collection box, wherein:

the second rolling member rotates to collect the garbage and the sewage on the ground and feed the garbage into the garbage collection box, a direction of rotation of the second rolling member is opposite to a direction of rotation of the first rolling member, and a speed of rotation of the first rolling member relative to a speed of rotation of the second rolling member is controlled to control movement of the bidirectional mobile cleaning device.

2. The bidirectional mobile cleaning device according to claim 1, wherein:

the first end of the garbage collection box is provided with a first garbage scraper lip, the first garbage scraper lip is used in cooperation with the first rolling member to feed the garbage and the sewage on the ground into the garbage collection box, the second end of the garbage collection box is provided with a second garbage scraper lip, and the second garbage scraper lip is used in cooperation with the second rolling member to feed the garbage and the sewage on the ground into the garbage collection box.

3. The bidirectional mobile cleaning device according to claim 1, comprising:

a first brush member and a second brush member disposed over the garbage collection box, wherein:

the first brush member is used to remove the garbage that adheres to the first rolling member from the first rolling member, and the second brush member is used to remove the garbage that adheres to the second rolling member from the second rolling member.

4. The bidirectional mobile cleaning device according to claim 3, wherein the first brush member and the second brush member are each configured to rotate.

5. The bidirectional mobile cleaning device according to claim 1, comprising:

a first sewage recovery member adjacent to the first rolling member and a second sewage recovery member adjacent to the second rolling member, wherein:

the first sewage recovery member is used to recover the sewage that is adsorbed on the first rolling member, and the second sewage recovery member is used to recover the sewage that is adsorbed on the second rolling member.

6. The bidirectional mobile cleaning device according to claim 5, wherein:

the first sewage recovery member defines a first sink structure, a bottom of the first sewage recovery member is provided with a first pressing portion having a first convex portion that presses the first rolling member, the bottom of the first sewage recovery member defines a first through hole for communicating with a surface of the first rolling member, the second sewage recovery member defines a second sink structure, a bottom of the second sewage recovery member is provided with a second pressing portion having a second convex portion that presses the second rolling member, and the bottom of the second sewage recovery member defines a second through hole for communicating with a surface of the second rolling member.

7. The bidirectional mobile cleaning device according to claim 6, wherein:

the first sewage recovery member defines a plurality of first through holes distributed in an array at the bottom of the first sewage recovery member, and the second sewage recovery member defines a plurality of second through holes distributed in an array at the bottom of the second sewage recovery member.

8. The bidirectional mobile cleaning device according to claim 6, wherein:

a first water supply port is provided at a first end of the first sewage recovery member, a first sewage collection port is provided at a second end of the first sewage recovery member, a second water supply port is provided at a first end of the second sewage recovery member, and a second sewage collection port is provided at a second end of the second sewage recovery member.

9. The bidirectional mobile cleaning device according to claim 1, wherein a bottom of the garbage collection box is provided with a load-bearing wheel.

10. The bidirectional mobile cleaning device according to claim 1, wherein the first rolling member is a flexible roller or a flexible belt or a roller brush.

11. The bidirectional mobile cleaning device according to claim 1, wherein the first rolling member comprises a plurality of rolling members arranged side-by-side.

12. The bidirectional mobile cleaning device according to claim 1, wherein the first rolling member comprises a plurality of rolling members arranged in series.

13. The bidirectional mobile cleaning device according to claim 1, comprising:

a first driver connected to the first rolling member and a second driver connected to the second rolling member, wherein:

the first driver is used to drive the first rolling member to rotate, and the second driver is used to drive the second rolling member to rotate.

14. The bidirectional mobile cleaning device according to claim 13, wherein the first driver is an electric motor or a hydraulic driver or a pneumatic motor.

15. The bidirectional mobile cleaning device according to claim 13, wherein:

a first transmission member is disposed between the first driver d the first rolling member, and the first transmission member is a helical tooth or a cone tooth or face tooth or a worm gear.

16. The bidirectional mobile cleaning device according to claim 15, wherein:

a second transmission member is disposed between the second driver and the second rolling member, and the second transmission member is a helical tooth or a cone tooth or a face tooth or a worm gear.

17. A bidirectional mobile cleaning device, comprising:

a garbage collection box;

a first rolling member disposed at a first end of the garbage collection box, wherein the first rolling member rotates to collect garbage on the ground and feed the garbage into the garbage collection box; and a second rolling member disposed at a second end of the garbage collection box, wherein:

the second rolling member rotates to collect the garbage on the ground and feed the garbage into the garbage collection box, a direction of rotation of the second rolling member is opposite to a direction of rotation of the first rolling member, and a speed of rotation of the first rolling member relative to a speed of rotation of the second rolling member is controlled to control movement of the bidirectional mobile cleaning device.

18. The bidirectional mobile cleaning device according to claim 17, comprising:

a first brush member and a second brush member disposed over the garbage collection box, wherein:

the first brush member is used to remove the garbage that adheres to the first rolling member from the first rolling member, and the second brush member is used to remove the garbage that adheres to the second rolling member from the second rolling member.

19. A bidirectional mobile cleaning device, comprising:

a garbage collection box;

a first rolling member disposed at a first end of the garbage collection box, wherein the first rolling member rotates to collect sewage on the ground;

a second rolling member disposed at a second end of the garbage collection box, wherein:

the second rolling member rotates to collect the sewage on the ground, a direction of rotation of the second rolling member is opposite to a direction of rotation of the first rolling member, and a speed of rotation of the first rolling member relative to a speed of rotation of the second rolling member is controlled to control movement of the bidirectional mobile cleaning device;

a first sewage recovery member adjacent to the first rolling member, wherein the first sewage recovery member is used to recover the sewage that is adsorbed on the first rolling member; and a second sewage recovery member adjacent to the second rolling member, wherein the second sewage recovery member is used to recover the sewage that is adsorbed on the second rolling member.

20. The bidirectional mobile cleaning device according to claim 19, wherein:

the first sewage recovery member defines a first sink structure, a bottom of the first sewage recovery member is provided with a first pressing portion having a first convex portion that presses the first rolling member, the bottom of the first sewage recovery member defines a first through hole for communicating with a surface of the first rolling member, the second sewage recovery member defines a second sink structure, a bottom of the second sewage recovery member is provided with a second pressing portion having a second convex portion that presses the second rolling member, and the bottom of the second sewage recovery member defines a second through hole for communicating with a surface of the second rolling member.

* * * * *